United States Patent [19]

Palomeque

[11] 4,177,783

[45] Dec. 11, 1979

[54] DUAL SPARK PLUG IGNITION SYSTEM

[76] Inventor: Osvaldo Palomeque, 4116 ½ N. Peck Rd., Apt. C, El Monte, Calif. 91732

[21] Appl. No.: 957,535

[22] Filed: Nov. 3, 1978

[51] Int. Cl.[2] ..... F02P 1/00

[52] U.S. Cl. ..... 123/148 C; 123/169 MG

[58] Field of Search ..... 123/148 C, 169 MG; 313/123, 128, 140

[56] References Cited

U.S. PATENT DOCUMENTS

| | | | |
|---|---|---|---|
| 1,156,796 | 10/1915 | Meaker . | |
| 1,246,376 | 11/1917 | Angler . | |
| 1,259,240 | 3/1918 | Jeffery | 123/148 C |
| 1,559,411 | 10/1925 | Espinosa . | |
| 2,590,778 | 3/1952 | Lautenberger | 123/148 C |
| 3,359,955 | 12/1967 | Turner . | |
| 3,809,042 | 5/1974 | Hosho . | |
| 4,020,388 | 4/1977 | Prah | 123/169 MG |

*Primary Examiner*—Ronald B. Cox
*Attorney, Agent, or Firm*—Marvin Jabin

[57] ABSTRACT

A dual spark plug ignition system for an internal combustion engine to decrease the production of air pollutants in the exhaust gases thereof, in which the spark plugs are set at an angle with respect to each other, and one is insulated, while the other one is grounded to the cylinder head. The electric spark is caused to jump the gap between the side electrode of the grounded spark plug and the central electrode of the insulated spark plug.

9 Claims, 3 Drawing Figures

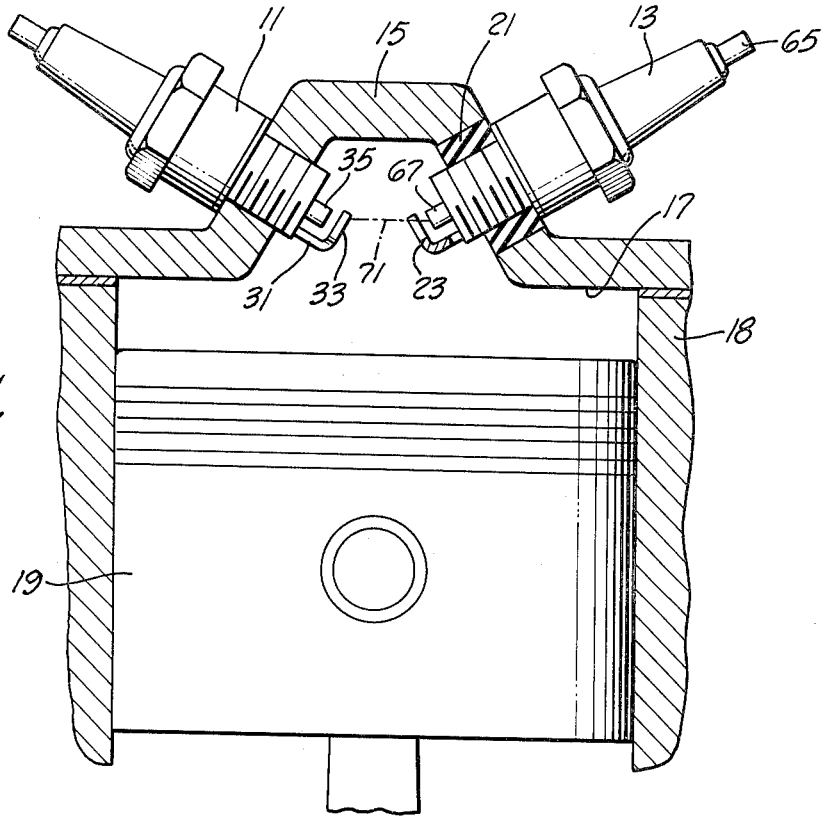
FIG. 1.
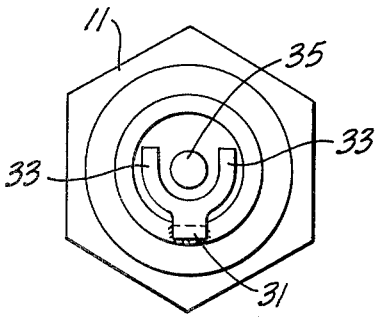
FIG. 2.
FIG. 3.
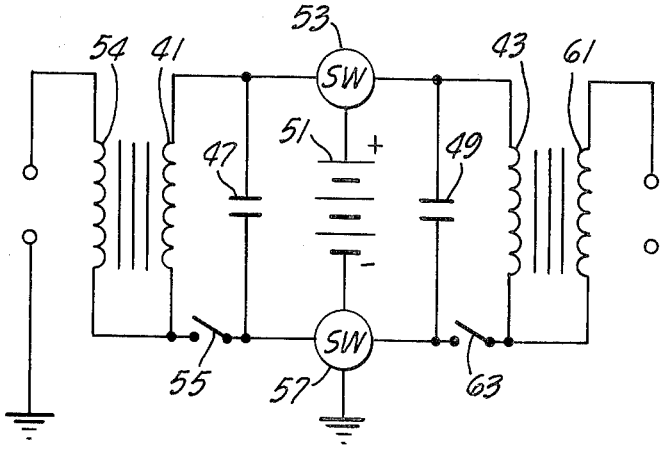

DUAL SPARK PLUG IGNITION SYSTEM

BACKGROUND OF THE INVENTION

The great increase in the number of automotive vehicles has created an air pollution problem throughout the world. As a result, much effort has been expended in an attempt to decrease the amount, not only of hydrocarbons and carbon monoxide in the exhaust gases, but also of nitrogen oxide, because of the formation of smog by the photochemical reaction in the air and its irritation of the eyes and respiratory systems of human beings.

The production of hydrocarbons and carbon monoxide occurs because of insufficient combustion in the engine cylinders. It is possible to decrease the amounts of those components considerably, by carrying out the combustion completely, as by providing a sufficient amount of air at high temperatures. Improvement in combustion efficiency results in an increase in the thermal effect of the engine. An increase in combustion temperatures, however, increases the production of nitrogen oxide. In contrast thereto, a lowering of the maximum combustion temperature has a tendency to suppress an increase in the combustion efficiency of the engine and to prevent, as a result thereof, the formation of nitrogen oxide in the exhaust gas.

Various measures have been proposed in an attempt to find a solution to the foregoing problem, such as controlling the spark advance, providing a mixture of gas that avoids the peak air-fuel ratio, recycling a part of the exhaust gas, injecting water and using a catalytic converter, but none of those measures has been entirely practical or satisfactory, and they often present new problems.

In the case of changing the spark advance, the output power tends to decrease and the fuel cost tends to increase in proportion to the reduction in the rate of nitrogen oxide production, and, in addition, the value of the decrease in nitrogen oxide cannot be made as large as is desired because the angle through which a change can be effected is limited. In the case of changing the mixing ratio of air-fuel, when the gas mixture is relatively thin or lean, an ignition failure frequently takes place, causing an instability in the number of revolutions of the engine, whereas, when the gas mixture is relatively rich, the contents of hydrocarbons and carbon monoxide in the exhaust gases becomes large and the fuel cost increases.

In the case of recycling the exhaust gas, in which a part of the exhaust gas is subjected to reintroduction into the engine by the suction effect of the latter, the ignition becomes unstable because of the presence of the uncombusted substances, and carbon or tar-like substances tend to be deposited in the system, such as in the suction pipe and the suction vane. In the water injection system, it is necessary to use as much water as fuel, and the apparatus for controlling the amount of water increases the cost of the vehicle. A satisfactory catalytic system with the desired purifying ability, the required service life and the desired operating costs has not yet been developed.

SUMMARY OF THE INVENTION

According to the preferred embodiment of the present invention, a dual spark plug ignition system includes a pair of spark plugs angularly disposed with respect to each other in an engine cylinder head. One of the spark plugs is electrically grounded to the upper surface of the cylinder and the other spark plug is electrically insulated therefrom.

Each of the spark plugs has a central electrode and a split or forked side electrode, and the electric spark of the ignition system is caused to jump the air gap between the central electrode of the insulated spark plug and the forked side electrode of the grounded spark plug.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings, in which:

FIG. 1 is a sectional view of a dual spark plug ignition system according to the present invention.

FIG. 2 is a bottom view of one of the spark plugs shown in FIG. 1.

FIG. 3 is an electrical circuit diagram for an ignition device according to the present invention.

DESCRIPTION OF THE PREFERRED EMBODIMENT

Turning now to the drawings, FIG. 1 shows spark plugs 11 and 13 mounted in the upper surface 15 of cylinder head 17 of engine block 18, above piston 19, which is connected to suitable crank shaft means, which is not shown. Spark plug 11 is screwed directly into the upper surface 15 of cylinder head 17 so as to be electrically grounded thereto, and spark plug 13 is screwed into threaded insulator 21, which in turn is screwed as an insert into upper surface 15, so that spark plug 13 is electrically insulated from cylinder 17. The cylinder intake and exhaust valves are not shown.

The spark plugs 11 and 13 are angularly mounted at approximately 115° to 130° with respect to each other upon the upper surface 15, and side electrode 23 of spark plug 13 is positioned approximately ¼ inch to ½ inch distant from side electrode 31 of spark plug 11. The upper surface 15 is shown having a configuration such that the described positioning of the spark plugs 11 and 13 can be effected, but other configurations which will achieve the desired positioning of the spark plugs 11 and 13 can be used just as well.

FIG. 2 shows how the split or forked ends 33 of side electrode 31 of spark plug 11 are arranged around central electrode 35. The inner extremities of ends 33 are separated by approximately 0.130 inches, so as to accommodate central electrode 35. The air gap between the central electrode 35 and side electrode 31 is the same as for conventional spark plugs. The spark plugs 11 and 13 are identical to each other and of conventional design, with the exception of the shape of the side electrodes.

FIG. 3 shows an electric circuit diagram for an ignition circuit that can be used with the spark plugs 11 and 13. Ignition coil windings 41 and 43 are connected at one end each to condensers 47 and 49, respectively, and then to the positive terminal of battery 51 through conventional change-over switch 53. The other terminal of ignition coil winding 41 is connected to one terminal of ignition coil winding 54 and to distributor 55, which in turn is connected to the other terminal of condenser 47 and to the negative terminal of battery 51 through grounded change-over switch 57. The other terminal of ignition coil winding 54 is connected to grounded spark plug 11 and the other terminal of ignition coil winding 61 is connected to insulated spark plug 13. Thus, spark plug 11, ignition coil windings 41 and 54 and distributor 55 form one ignition circuit, and spark plug 13, ignition coil windings 43 and 61 and distributor 63 form another ignition circuit. Each ignition circuit includes a condenser which is alternately connected through a change-over switch to a battery.

A sufficient electric potential is applied to the cap 65 of spark plug 13 to cause an electric spark to jump the gap between central electrode 67 of spark plug 13 and the forked side electrode 31 of spark plug 11, as indicated by the spark 71.

The described ignition system provides an internal combustion system with a significantly reduced amount of air pollutants in the exhaust gas, without a loss of output power or deterioration of the operation of the engine.

While particular embodiments of the present invention have been shown and described, it will be obvious to those skilled in the art that changes and modifications may be made without departing from this invention in its broader aspects, and that the intention is to cover all such changes and modifications as fall within the true spirit and scope of this invention.

I claim:

1. An ignition system for an internal combustion engine for reducing the amount of air pollutants in the exhaust gases thereof, comprising:

(a) a first spark plug having central and side electrodes and being mounted upon a cylinder of said engine and electrically grounded to said cylinder; and (b) a second spark plug having central and side electrodes and being mounted upon said cylinder and electrically insulated therefrom, said first and second spark plugs being separated by an air gap and angularly disposed with respect to each other and being operatively connected to electrical distributor means which causes an electric spark to jump said air gap between said first and second spark plugs.

2. Apparatus as defined in claim 1 in which said electric spark jumps the air gap between said central electrode of said insulated second spark plug and said side electrode of said grounded first spark plug.

3. Apparatus as defined in claim 2 in which each of said side electrodes of said first and second spark plugs is forked so as to be divided about its respective central electrode.

4. Apparatus as defined in claim 3 in which said first spark plug is screwed directly into the head of said cylinder and said second spark plug is screwed into an insulating insert within the head of said cylinder, the central and side electrodes of said first and second spark plugs extending into the combustion space of said cylinder.

5. Apparatus as defined in claim 4 in which said first and second spark plugs are mounted within a recess in the head of said cylinder.

6. Apparatus as defined in claim 5 in which said first and second spark plugs are disposed at an angle of approximately 115° to 130° with respect to each other.

7. Apparatus as defined in claim 6 in which the side electrodes of each of said first and second spark plugs are positioned approximately ¼ to ½ of an inch apart.

8. Apparatus as defined in claim 7 in which the separated ends of each of said forked side electrodes are approximately 0.130 inches apart.

9. Apparatus as defined in claim 1 in which each of said side electrodes of said first and second spark plugs is forked so as to be divided about its respective central electrode.

* * * * *